US005790986A

United States Patent [19]

Hall

[11] Patent Number: 5,790,986

[45] Date of Patent: Aug. 11, 1998

[54] ARTICLE OF HEADWEAR

[76] Inventor: Jason Hamilton Hall, 58 Manning Street, Scarborough, Western Australia, Australia, 6019

[21] Appl. No.: 640,955

[22] PCT Filed: Jan. 6, 1995

[86] PCT No.: PCT/AU95/00005

§ 371 Date: May 17, 1996

§ 102(e) Date: May 17, 1996

[87] PCT Pub. No.: WO95/18549

PCT Pub. Date: Jul. 13, 1995

[30] Foreign Application Priority Data

Jan. 10, 1994 [AU] Australia ..... PM3271

[51] Int. Cl.[6] ..... A42B 1/06

[52] U.S. Cl. ..... 2/172; 2/195.1; 2/195.2; 2/207

[58] Field of Search ..... 2/171, 172, 195.1, 2/195.2, 195.3, 195.4, 207

[56] References Cited

U.S. PATENT DOCUMENTS

D. 135,321 3/1943 Harpignies ..... 2/195.1
2,704,366 3/1955 Arnold ..... 2/172
2,735,110 2/1956 Baker .
4,593,417 6/1986 Brown, Jr. et al. .
5,161,260 11/1992 Reynolds ..... 2/171
5,212,837 5/1993 Gose et al. .

*Primary Examiner*—Diana Biefeld
*Attorney, Agent, or Firm*—Kerkam, Stowell, Kondracki & Clarke, P.C.; John C. Kerins

[57] ABSTRACT

An article of headwear is provided which includes a substantially forwardly projecting peak or visor, an adjustable head engaging band and a length or sheet of material, the head engaging band being attached or attachable to the peak or visor at or near a rear edge thereof, the length or sheet of material being attached or attachable to the peak or visor and extending rearwardly thereof, whereby the peak or visor may be positioned on a wearer's head such that the material covers the wearer's head and hangs therefrom about the shoulders and neck of the wearer, wherein the head engaging band is positioned about a rear of the wearer's head such that the peak or visor is held in position thereon, and the material has a plurality of fasteners to adjust and fasten the material into a plurality of positions to protect a wearer's neck, head, and/or face.

17 Claims, 12 Drawing Sheets

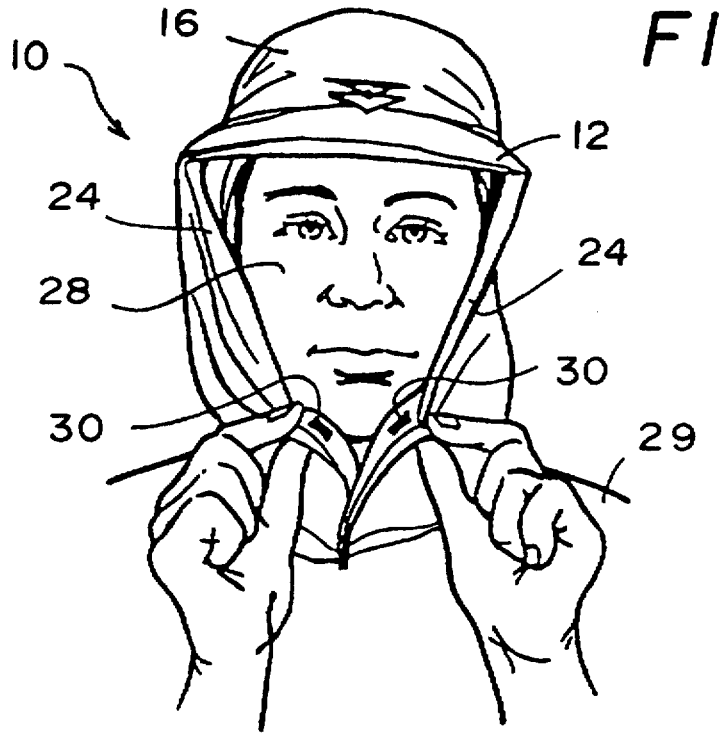
FIG. 7
FIG. 8
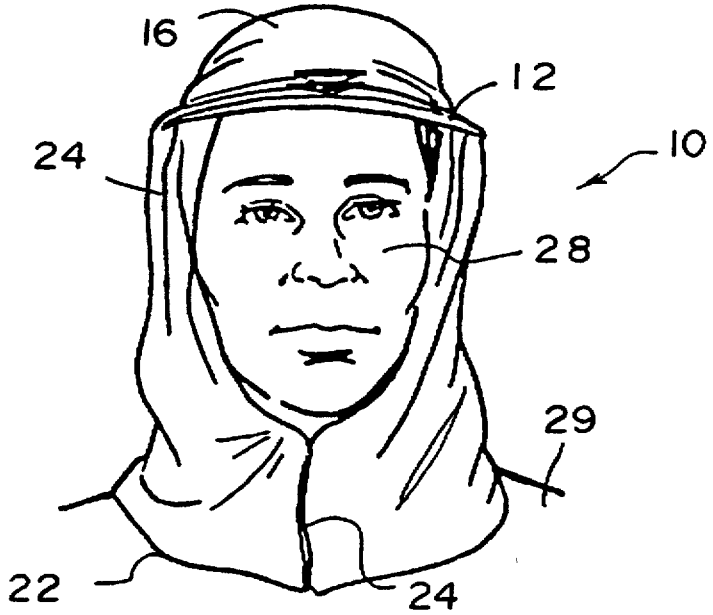

ARTICLE OF HEADWEAR

FIELD OF THE INVENTION

This invention relates to an article of headwear. More particularly, the article of headwear of the present invention is intended for use in protecting a wearer from exposure to the elements, for example sun, wind and rain.

DISCUSSION OF THE PRIOR ART

Typically, articles of headwear such as caps and hats have a crown portion within which a wearer's head may be received and a peak or brim. The peak or brim is intended to shield the wearer from the sun although its effectiveness is dependent upon the width or length of the peak or brim and the angle thereof with respect to the position of the sun. For example, if a wearer is bending forward for a period the typical brim provided about the circumference of a hat will not protect the wearer's neck if the sun is positioned overhead. Further, little protection is provided against wind and rain by the typical peak or brim arrangement.

BRIEF DESCRIPTION OF THE INVENTION

In accordance with a first aspect of the present invention there is provided an article of headwear characterised by a substantially forwardly projecting peak or visor, an adjustable head engaging band and a length or sheet of material, the head engaging band being attached or attachable to the peak or visor at or near a rear edge thereof, the length or sheet of material being attached or attachable to the peak or visor and extending rearwardly thereof, whereby the peak or visor may be positioned on a wearer's head such that the material covers the wearer's head and hangs therefrom about the shoulders and neck of the wearer, wherein the head engaging band is positioned about a rear of the wearer's head such that the peak or visor is held in position thereon, the material having provided thereon one or more fastening means whereby the material may be adjusted or arranged to protect the wearer's neck and/or face, the fastening means being arranged on the material such that the material may be drawn to a number of positions in front of the wearers neck and/or head and/or face and the material fastened together releasably in a number of arrangements as desired by the wearer.

Preferably, the length or sheet of material is of sufficient length to reach the shoulders of the wearer and to cover their neck. It is further preferable that the material be of such dimensions that either side thereof may be drawn around the neck and/or face of the wearer and releasably fastened in such a position to protect same.

Still preferably, a number of releasable attachment means are provided at various points on the length of material.

DESCRIPTION OF THE DRAWINGS

The present invention will now be described, by way of example only, with reference to the accompanying drawings, in which:

FIGS. 7 to 22 inclusive show a variety of configurations of the length of material possible with various arrangements of releasable attachment means that are provided thereon.

DESCRIPTION

In FIGS. 1 to 22 there is shown an article of headwear 10 comprising a peak or visor 12, an adjustable head engaging band 14 and a length or sheet of material 16.

Figure 1:
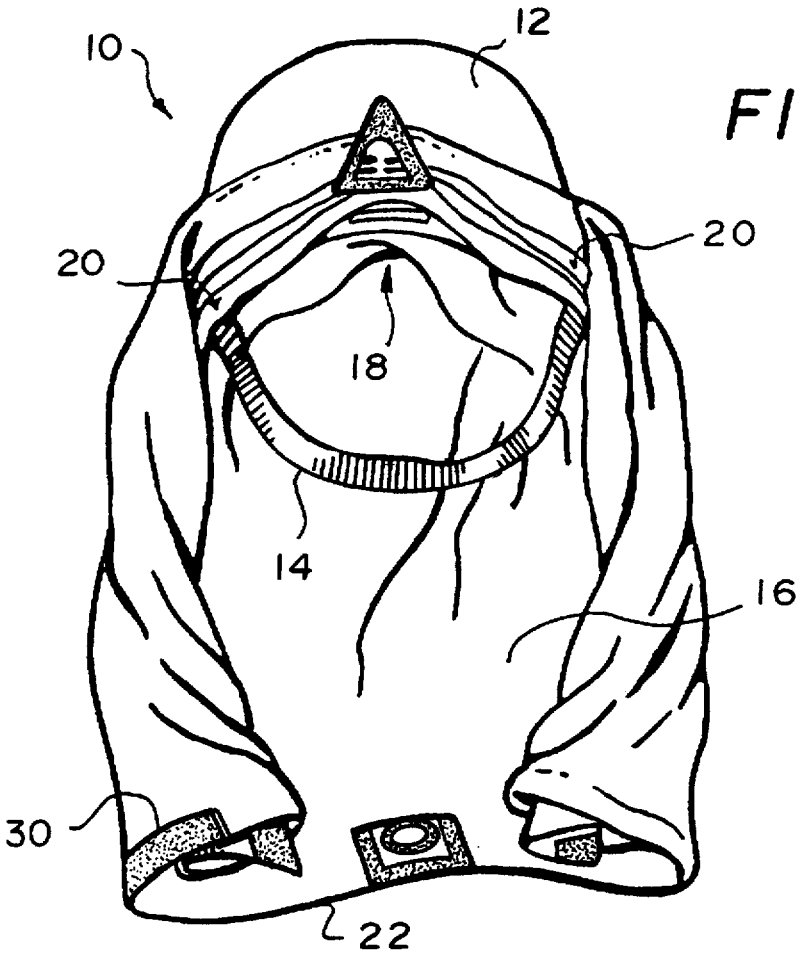
FIG. 1 is a top view of an article of headwear in accordance with the present invention.

The visor 12 is formed in a substantially crescent shape describing a hollow 18 in a rear edge and two side or lateral points 20 projecting rearwardly. The head engaging band 14 being attached to the visor 12 in a manner such that at least a portion thereof extends between the points 20, as is best seen in FIG. 1.

Figure 2:
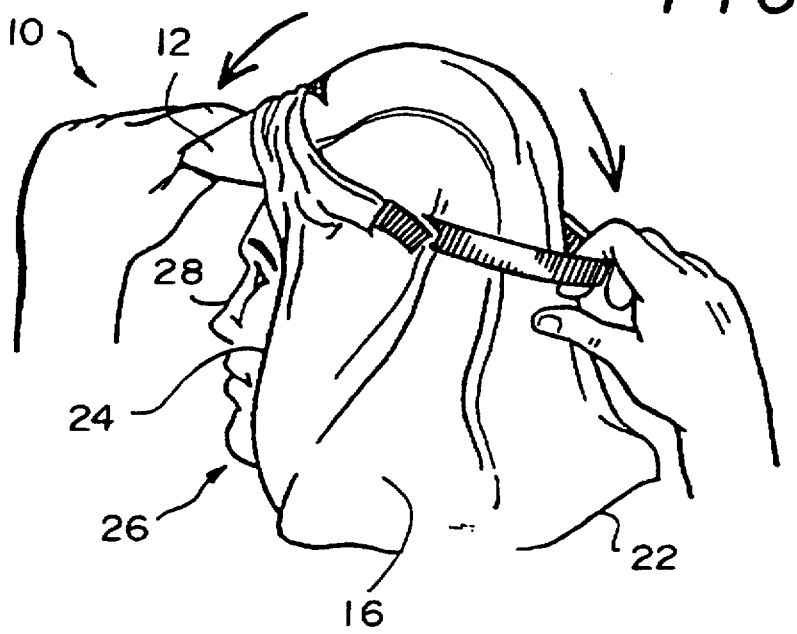
FIG. 2 is an upper perspective view of a wearer placing the headwear of FIG. 1 on his head.

The length of material 16 is fixed to an upper surface of the visor 12 towards the rear edge thereof. Such fixing may be by way of stitching although this should not in any way be considered to narrow the scope of the present invention. The length of material 16 is gathered or pleated on the visor 12, as is best seen in FIGS. 1 and 2. The-length of material 16 gathered and fixed to the visor 12 covers the head engaging band 14 also attached to the visor 12.

Figure 4:
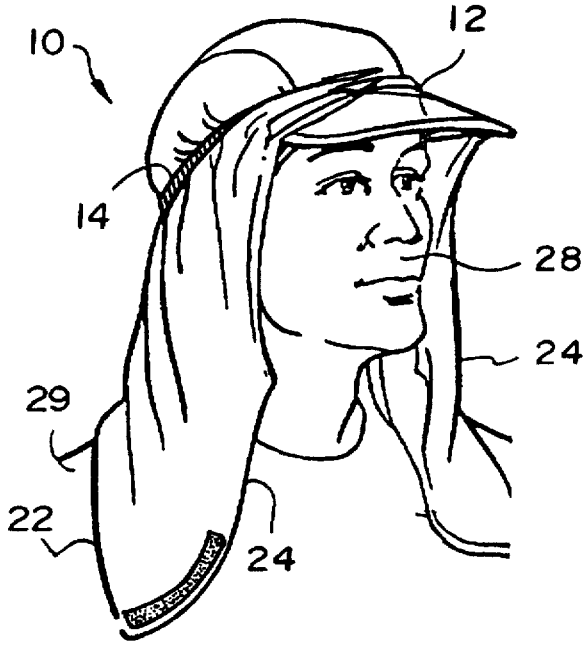
FIG. 4 is a front view of the headwear of FIG. 1 in position on the wearer's head.

The material 16 hangs from the visor 12 and has a substantially lowermost edge 22 and sides 24 when in position on a head 26 of a wearer, as is shown in FIG. 2. Typically, the sides 24 of the material hang at the sides of the wearer's face 28. The lowermost edge 22 hangs adjacent the shoulders 29 of the wearer and below the neckline, as is best seen in FIG. 4.

A plurality of releasable fastening means 30 are provided at various points on the material 16, as is shown in FIGS. 1, 4, 6, 7, 9, 11, 12, 14, 16 and 19. The variable placement of the fastening means 30 allows a variety of arrangements of the material 16 to be adopted.

Figure 3:
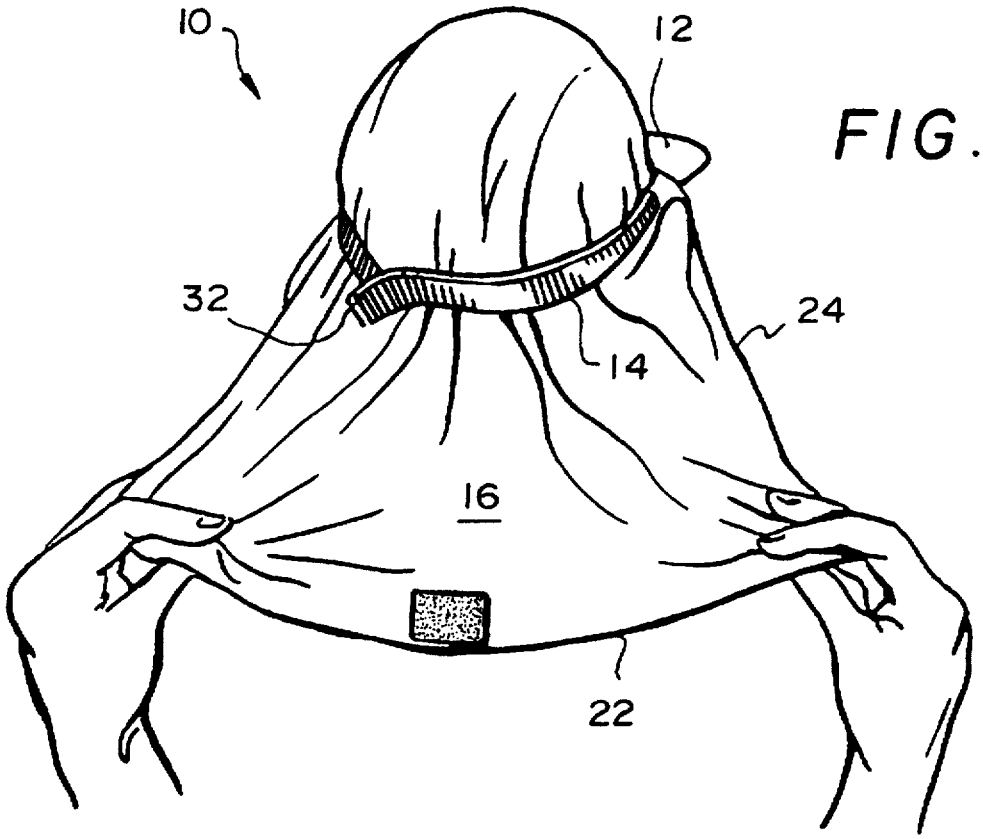
FIG. 3 is a rear view of the headwear of FIG. 1 on the wearer's head showing the head engaging band at the rear of the head and the partial width of the length of material.

The portion of the band 14 extending between the points 20 has provided therein a releasable and adjustable join 32, as can be seen in FIG. 3. The join 32 allows the continuity of the band 14 to be broken and reattached to adjust the length of the band 14 to suit the head 26 of the wearer. The band 14 has provided thereon both components of a hook and loop type fastener, for example that sold under the trade name "Velcro". The plurality of releasable fastening means 30 are also formed of either component of such a hook and loop type fastener.

Figure 5:
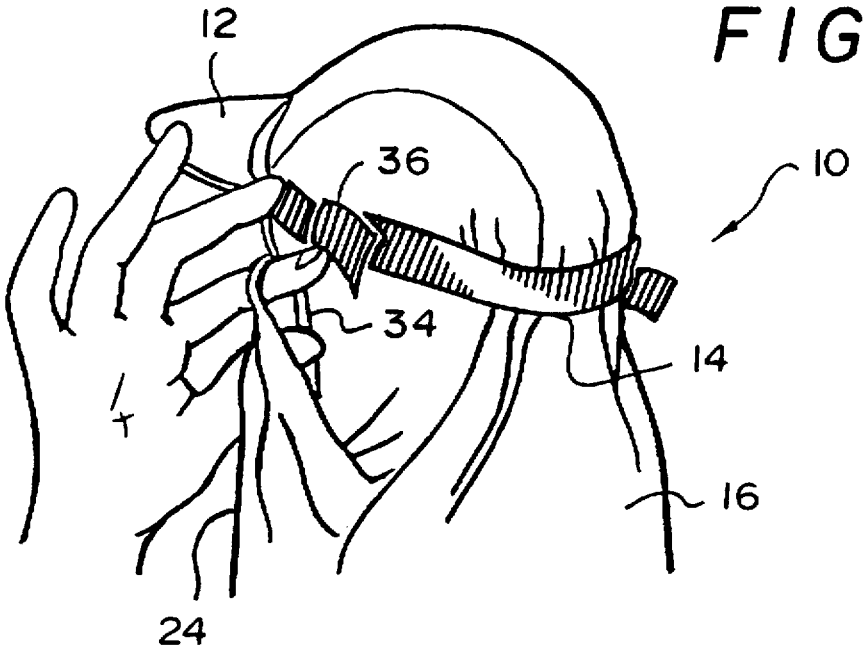
FIG. 5 is a rear view of the headwear of FIG. 1 on which a fastening means is provided allowing the length of material to be held in a partially raised position.
Figure 6:
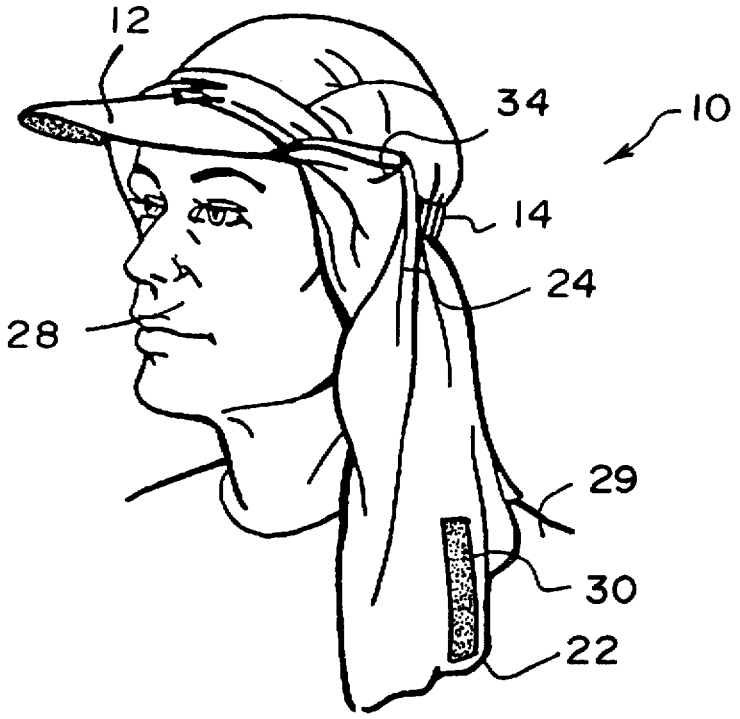
FIG. 6 is a front view of the headwear of FIG. 5 having the partially raised length of material.

In FIGS. 5 and 6 there is shown the headwear 10 to which an elongate fastening means, for example a strip 34 is added at each side 24 of the material 16. The strips 34 may be held to the band 14 by way of insertion behind a flap 36 of fastening material provided on the band. Such an arrangement holds the sides 24 of the material 16 away from the face 28 of the wearer, as is seen in FIG. 6.

In FIGS. 7 and 8 is shown an arrangement of releasable fasteners 30 on the material 16 allowing protection of the wearer's neck in that the sides 24 join under the wearer's chin.

Figure 9:
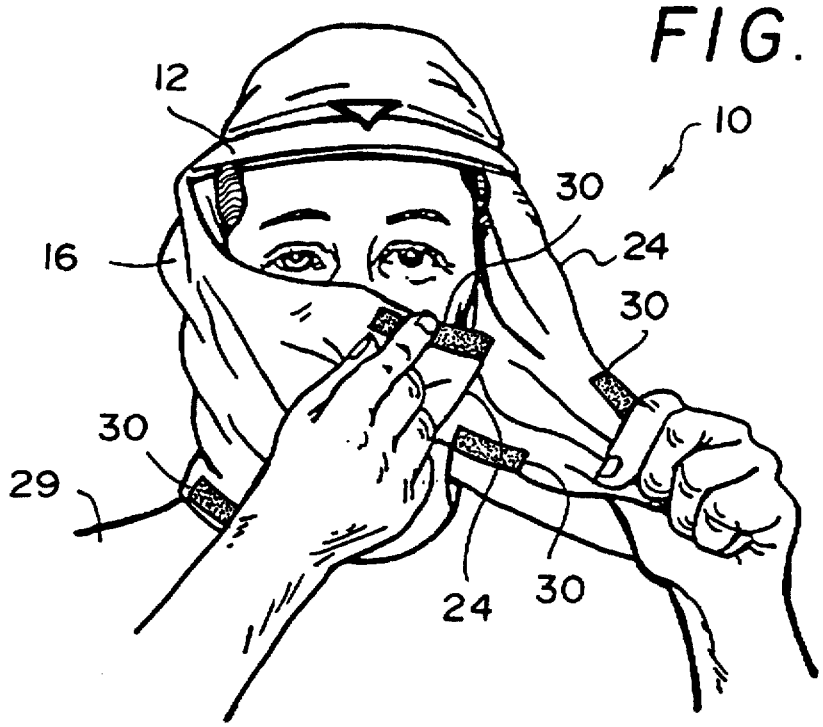
Figure 10:
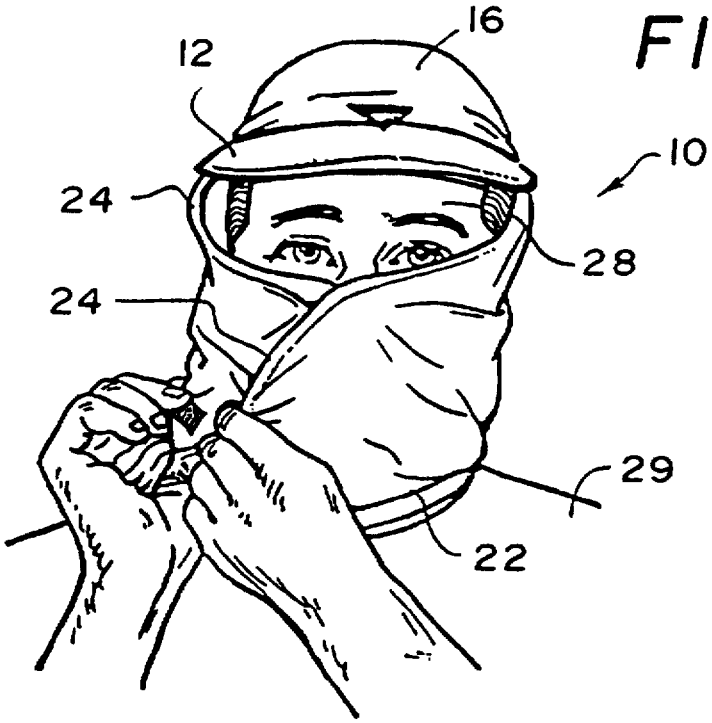

In FIGS. 9 and 10 there is shown an arrangement whereby the sides 24 of the material 16 overlap and cover most of the face 28 of the wearer other than the eyes. The overlapping of the sides 24 requires that fastening means 30 be provided at points spaced apart from the sides 24 and the edge 22.

Figure 11:
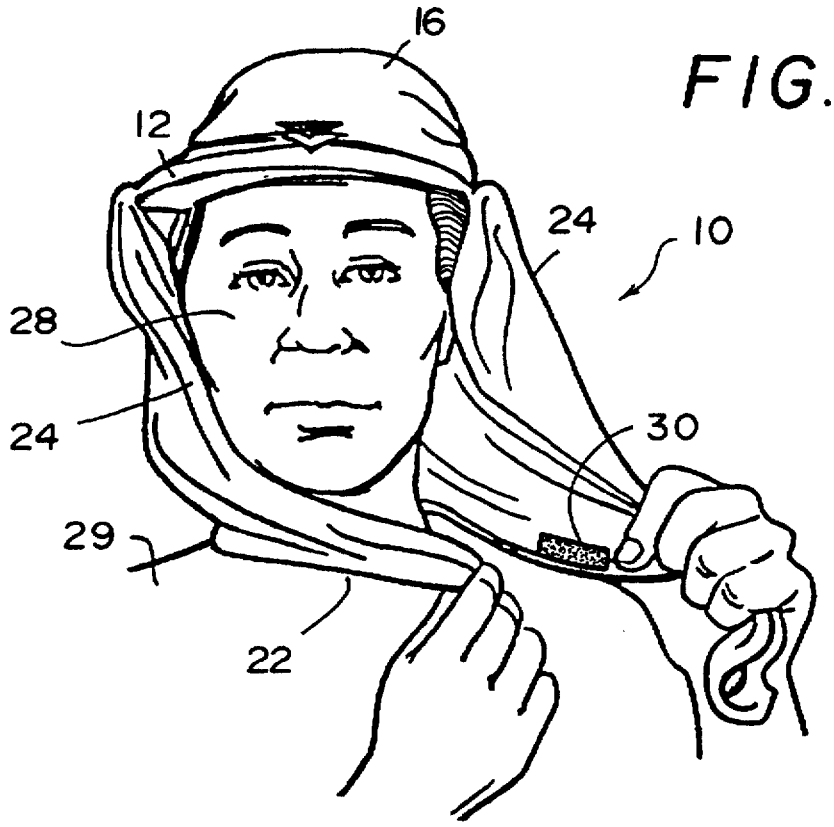
Figure 12:
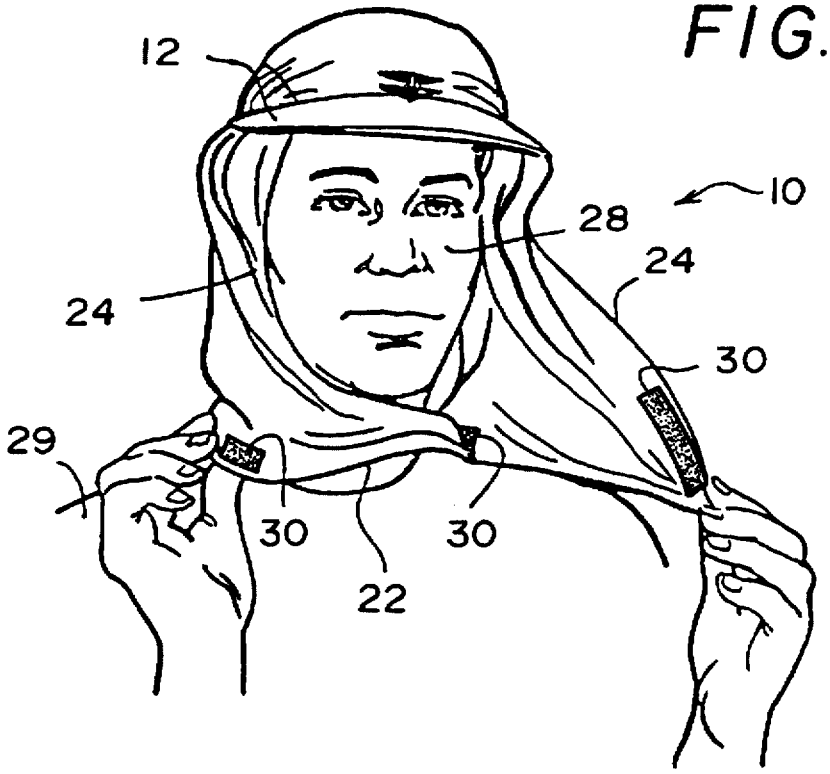
Figure 13:
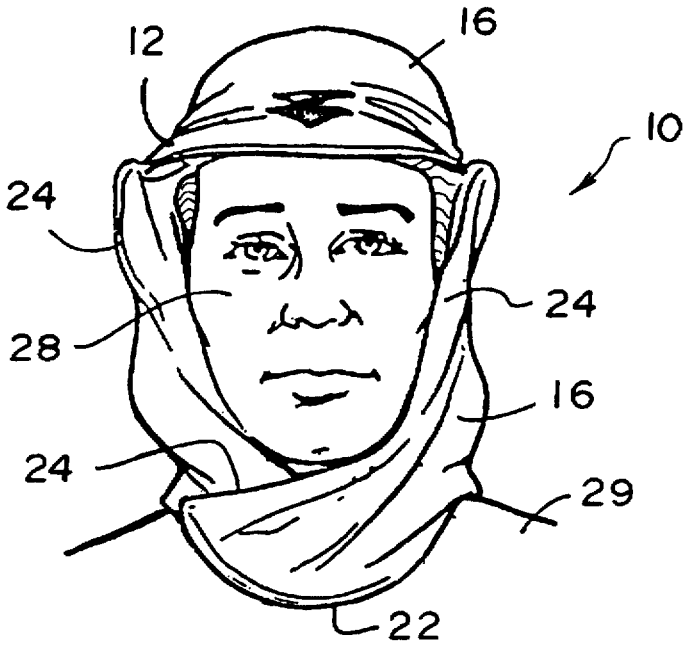

In FIGS. 11 to 13 there is shown an arrangement whereby the provision of only four fastening means 30 about the sides 24 and edges 22 of the material allows an overlapping arrangement linking the sides under the chin of the wearer. In such an arrangement, a fastening means 30 is provided at the junction of each side 24 and edge 22 and at a point spaced apart therefrom adjacent the edge 22.

Figure 14:
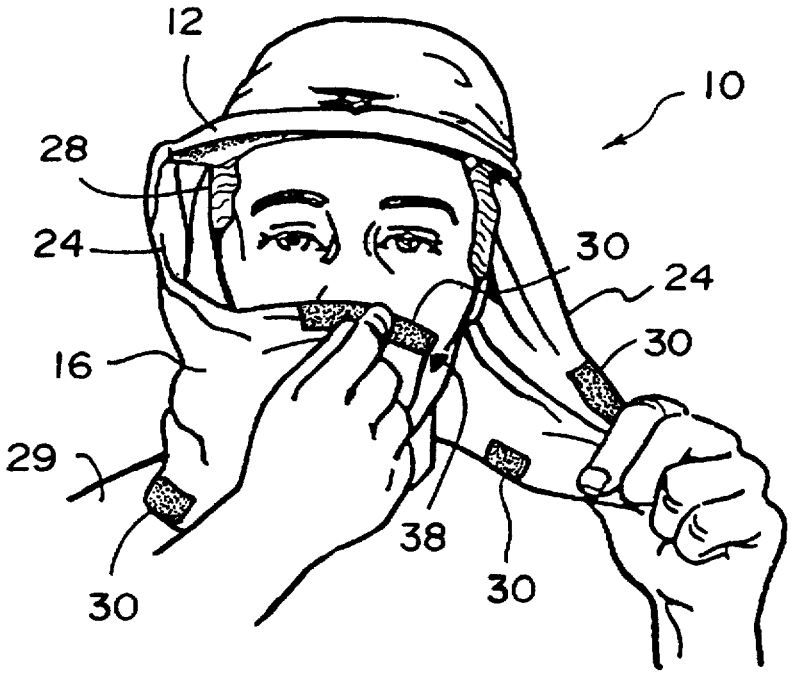
Figure 15:
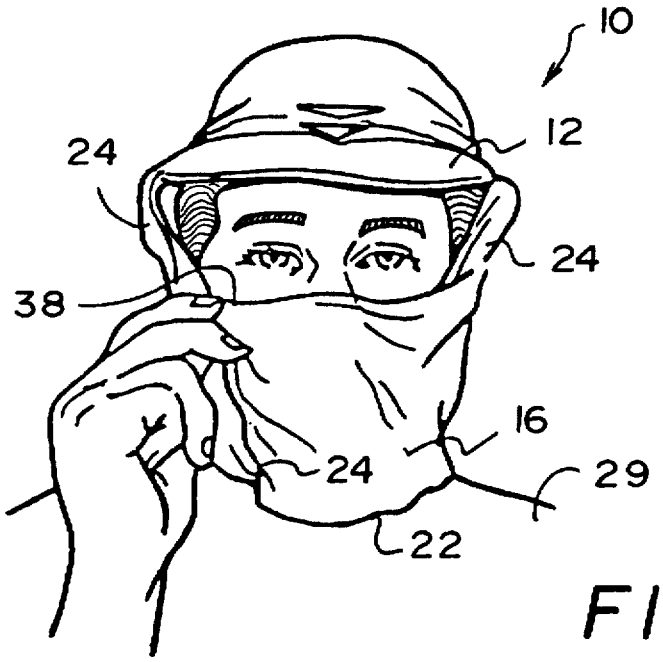

In FIGS. 14 and 15 there is shown an arrangement of fastening means 30 in combination with the strap 34 of FIG. 5 whereby the majority of the face 28 may be covered. Such an arrangement is facilitated by the shaping of the material 16 at its sides 24, in particular the provision of point 38 therealong. Further, fastening means 30 are provided at points 38 on the sides 24, at the edges 22 and at the junction of the sides 24 and edges 22.

Figure 16:
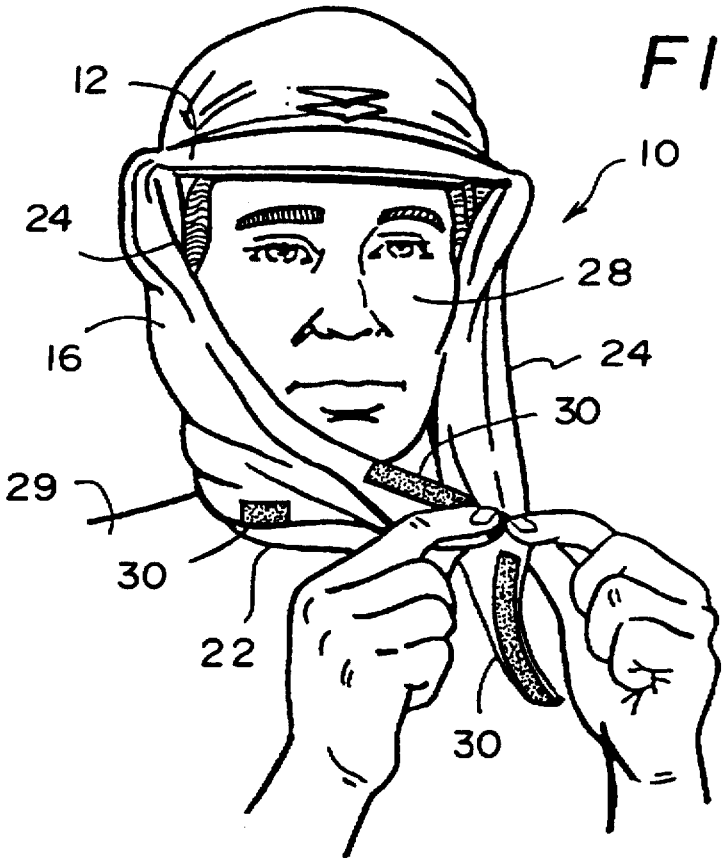
Figure 17:
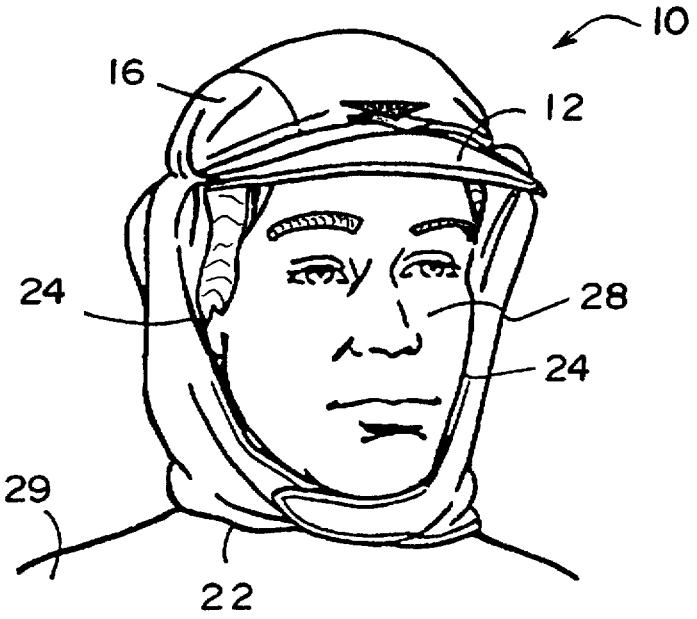
Figure 18:
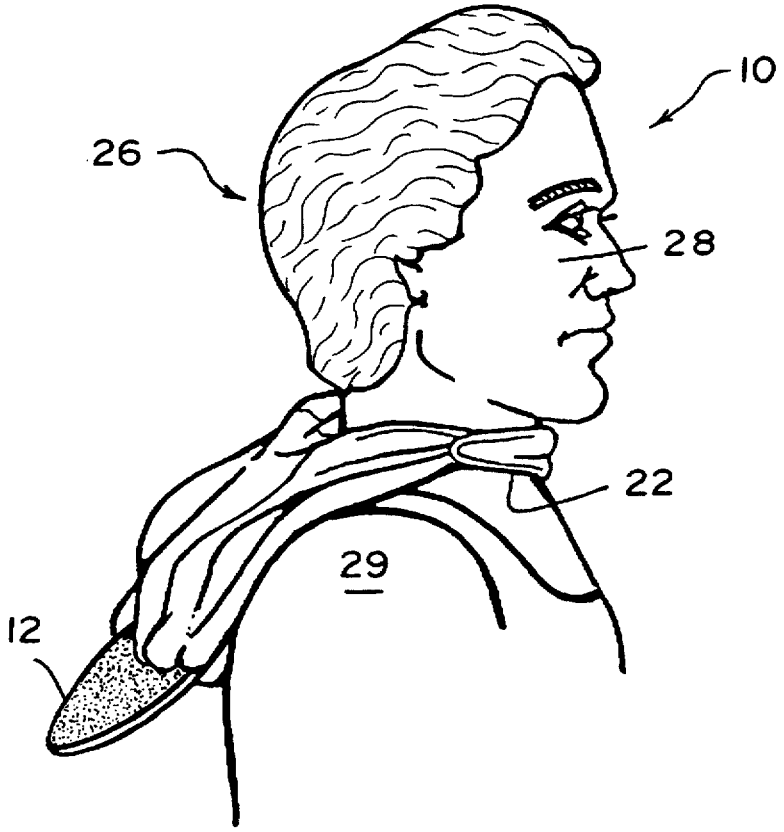

In FIGS. 16 to 17 there is shown a further arrangement whereby the sides 24 are fastened under the chin of the wearer leaving the face 28 exposed but in which the side of the head and the neck are protected. The visor 12 may be pulled backward off the head 26 so that the headwear 10 hangs from the neck of the wearer, as is shown in FIG. 18.

Figure 19:
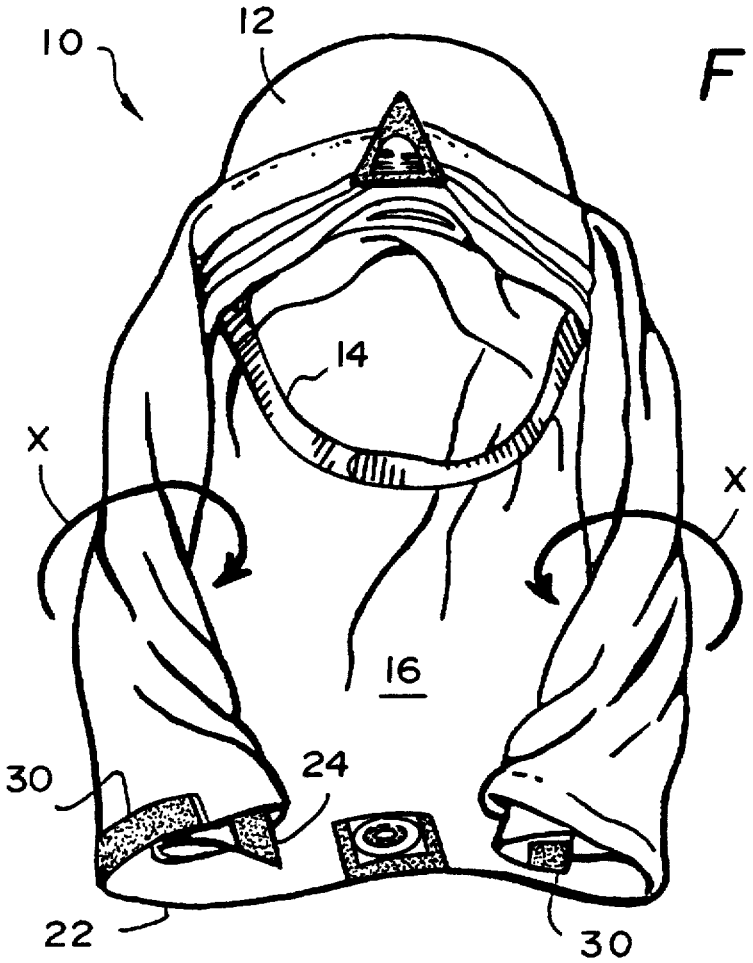
Figure 20:
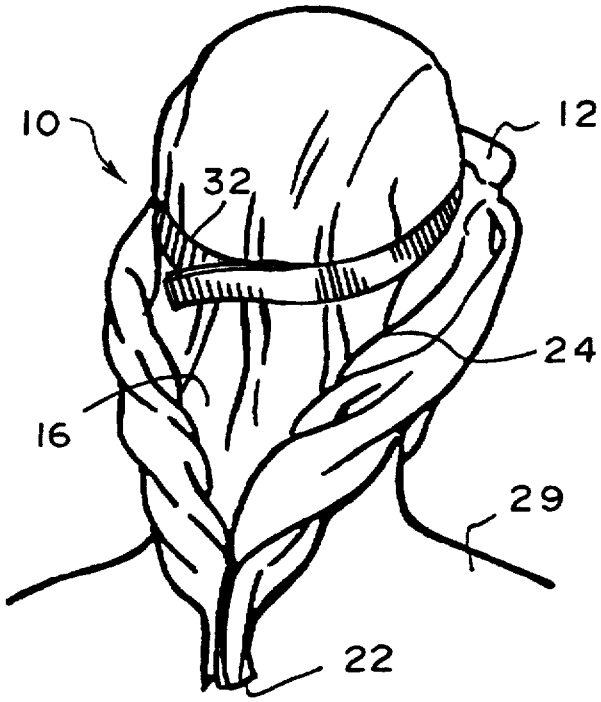

In FIGS. 19 and 20 are shown an arrangement of the material 16 whereby the sides 24 thereof are rolled up (as indicated by arrows X) and joined to each other behind the head 26 of the wearer.

Figure 21:
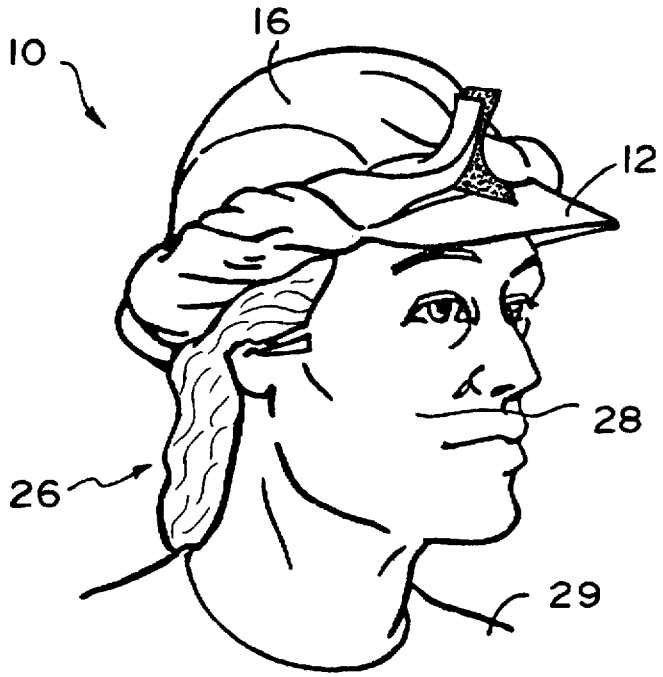
Figure 22:
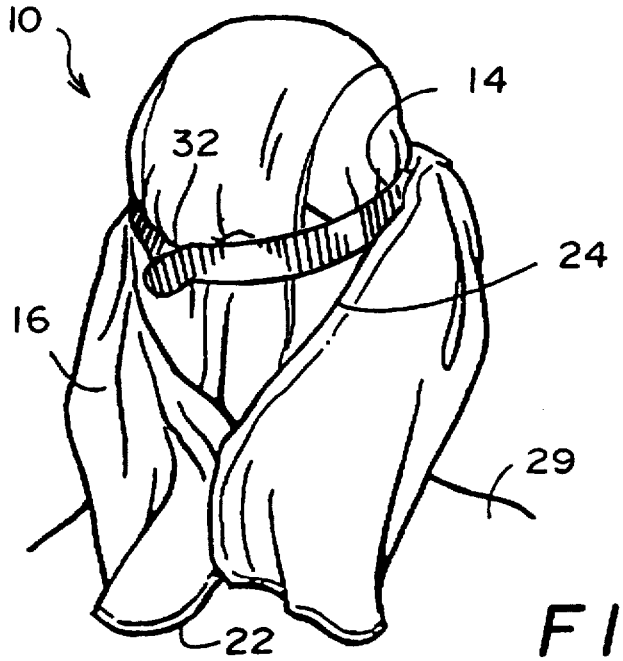
Figure 23:
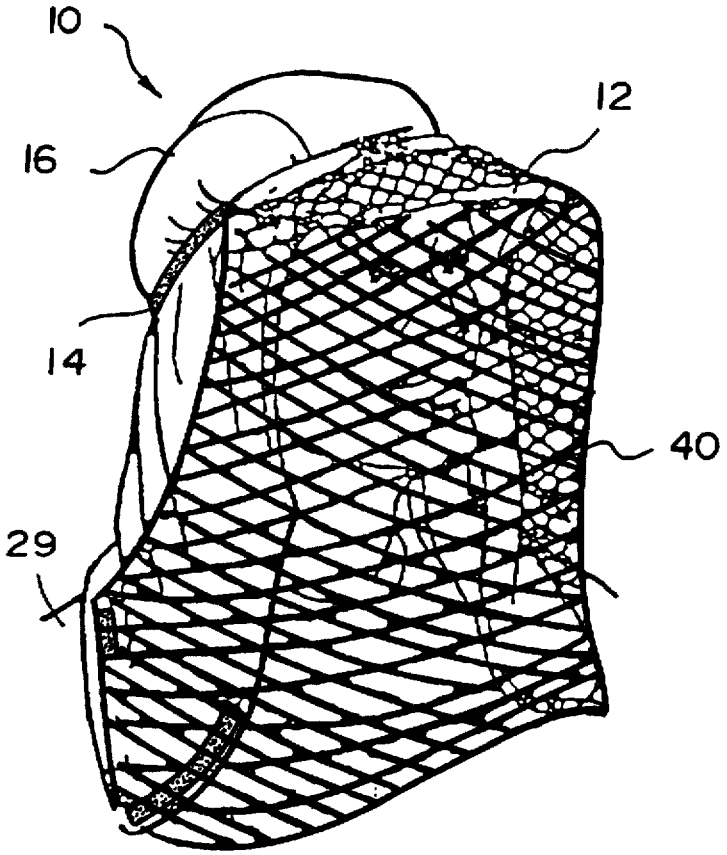
FIG. 23 is a front view of the headwear of FIG. 1 having an insect screen provided thereon to protect the face of the wearer.

Two further possible arrangements of the material 16 are shown in FIGS. 21 and 22. FIG. 23 shows the article of headwear 10 to which has been attached an insect screen 40 to shield the face 28 of the wearer.

In use, the wearer wishing to fit the article of headwear 10 to his head 26 will grip the article of headwear 10 by the visor 12 and will position same such that the wearer's forehead is received within the hollow 18 in the rear edge of the visor 12. The material 16 is draped over the crown of the wearer's head 26 and hangs therefrom about the wearer's neck and shoulders 29, as can be seen in FIG. 2.

The wearer may at this point adjust the head engaging band 14 about the rear of their head 26 such that the material 16 is held there against and in effect forming a crown for the article of headwear 10, as is clearly seen in FIGS. 3 to 6.

It is possible that the length of the head engaging band 14 may be adjusted by the wearer before the article of headwear 10 is placed on the wearer's head 26.

The wearer may subsequently adjust the article of headwear 10 through manipulation of the material 16 to protect in addition the wearer's face 28 and/or neck, as can be seen with reference to FIGS. 5 to 22.

If the wearer wishes to be protected from insects then he may choose to attach an insect screen 40 to the article of headwear 10, as is shown in FIG. 23. The insect screen 40 thereby shields the face 28 of the wearer.

It is envisaged that the material 16 be a flexible or pliable light weight material, for example a material woven from the fibre marketed under the trade mark "Lycra". For applications in the wet the material should be water resistant or water proof. It is also envisaged that one or more pockets may be provided on the material 16 to facilitate the carrying of small objects therein. The material 16 also need not necessarily be gathered on the upper surface of the visor 12 but may simply be fixed releasably or otherwise thereto.

It is still further envisaged that forms of adjustable fastening means other than "Velcro" may be used, including press studs, buttons and hooks and eyes. Further, the strips 34 and the flap 36 may be replaced by press studs, buttons or hooks and eyes. Still further, the visor 12 may be provided in a form other than a crescent if so desired.

The article of headwear of the present invention provides protection against the elements such as sun, wind and rain.

Modifications and variations such as would be apparent to the skilled addressee upon a reading of the specification are considered to fall within the scope of the present invention.

I claim:

1. An article of headwear characterized by a substantially forwardly projecting peak or visor, an adjustable head engaging band and a length or sheet of material, the head engaging band being attached to the peak or visor at or near a rear edge thereof, the length or sheet of material being attached to the peak or visor and extending rearwardly thereof, whereby the peak or visor may be positioned on a wearer's head such that the material covers the wearer's head and hangs therefrom about the shoulders and neck of the wearer, said material having a first side edge and a second side edge along a length of the material which are designed to extend alongside a wearer's face, and a lowermost edge extending from said first side edge to said second side edge, wherein the head engaging band may be positioned about a rear of a wearer's head such that the peak or visor is held in position thereon, the material having provided thereon a plurality of fastening means whereby the material may be adjusted or arranged and fastened to protect a wearer's neck and/or face, the fastening means being arranged on the material such that the material may be drawn to a number of positions in front of a wearer's neck and/or head and/or face and the material fastened together releaseably in a number of arrangements as desired by a wearer, a first of said fastening means being positioned along said first and second side edges and a second of said fastening means being positioned at a location spaced apart from said first and second side edges.

2. An article of headwear according to claim 1, characterized in that a number of fastening means are provided along said lowermost edge and said first and second side edges of the material when in position on a wearer's head whereby the first and second side edges may be drawn together and fastened to protect a wearer.

3. An article of headwear according to claim 1 characterized in that said first and second side edges of the length of material are proportioned whereby they can be overlapped when adjusted or arranged to each extend across and protect a wearers neck and/or head and/or face.

4. An article of headwear according to claim 1, 2 or 3, characteriszed in that the fastening means are provided in the form of a hook and loop type fastener.

5. An article of headwear according to claim 1, characterized in that the material is a flexible or pliable material capable of conforming to the crown of a wearer's head and hanging therefrom.

6. An article of headwear according to claim 1 characterized in that the length of material is attached to the visor such that sides of the length of material hang from the visor over the sides of the visor and in turn the sides of a wearer's face.

7. An article of headwear according to claim 1 characterized in that the head engaging band has an adjustment means provided therein allowing the length of the band to be adjusted to suit the size of a wearer's head.

8. An article of headwear according to claim 7, characterized in that the adjustment means of the band comprises a releasable and adjustable join whereby the continuity of the band may be broken and reattached to adjust the length of the band to suit the head of a wearer.

9. An article of headwear according to claim 8, characterized in that the band is formed in part from a hook and loop type fastening allowing the length of the band to be adjusted.

10. An article of headwear according to claim 1, characterized in that the material has a third fastening means provided thereon allowing the material to be releaseably attached to the band.

11. An article of headwear according to claim 10, characterized in that the fastening means allowing the material to be releasably attached to the band is provided in the form of one or more straps capable of being held to the band.

12. An article of headwear according to claim 1, characterized in that the peak or visor is formed of a rigid material in a crescent shape whereby the forehead of a wearer may be received within a hollow described by the crescent shaped peak or visor.

13. An article of headwear according to claim 12, characterized in that the material is fixedly attached to the peak or visor adjacent a rear edge thereof.

14. An article of headwear according to claim 12, characterized in that the material is fixedly attached to the peak or visor adjacent a rear edge thereof.

15. An article of headwear according to claim 1 wherein said second fastening means is positioned at a point adjacent said lowermost edge.

16. An article of headwear according to claim 1 wherein said second fastening means is positioned at a location spaced apart from said lowermost edge of said material.

17. An article of headwear according to claim 1 wherein said second fastening means is positioned at a point adjacent said lowermost edge, and wherein a third fastening means is provided on a surface of said material opposite a surface on which said first fastening means is disposed.

* * * * *